US005471931A

United States Patent [19]

Gardner

[11] Patent Number: 5,471,931

[45] Date of Patent: Dec. 5, 1995

[54] WATER RESISTANT SHOT WAD

[75] Inventor: Robert J. Gardner, Bethalto, Ill.

[73] Assignee: Olin Corporation, East Alton, Ill.

[21] Appl. No.: 333,112

[22] Filed: Nov. 1, 1994

Related U.S. Application Data

[63] Continuation of Ser. No. 967,319, Oct. 28, 1992, abandoned.

[51] Int. Cl.[6] ..... F42B 7/08

[52] U.S. Cl. ..... 102/449; 102/532

[58] Field of Search ..... 102/448–463, 102/532

[56] References Cited

U.S. PATENT DOCUMENTS

| | | | |
|---|---|---|---|
| 2,582,125 | 1/1952 | Holmes | 102/461 |
| 3,022,734 | 2/1962 | Kidder | 102/461 |
| 3,289,586 | 12/1966 | Horn et al. . | |
| 3,299,813 | 1/1967 | Rickey . | |
| 3,402,664 | 9/1968 | Cramer | 102/451 |
| 3,469,527 | 9/1969 | Pace . | |
| 3,623,431 | 11/1971 | Hendricks . | |
| 3,670,650 | 6/1972 | McCaffrey et al. . | |
| 3,750,580 | 8/1973 | Nomura et al. | 102/450 |
| 3,786,753 | 1/1974 | Eckstein et al. | 102/449 |
| 3,788,224 | 1/1974 | Merritt . | |
| 4,220,090 | 9/1980 | Fackler | 102/449 |
| 4,233,903 | 11/1980 | Lage | 102/466 |
| 4,669,385 | 6/1987 | Maki | 102/453 |
| 4,676,170 | 6/1987 | Roster | 102/449 |
| 4,679,505 | 7/1987 | Reed | 102/449 |
| 4,815,389 | 3/1989 | Jakonczuk | 102/453 |

FOREIGN PATENT DOCUMENTS

| | | | |
|---|---|---|---|
| 2343219 | 9/1977 | France | 102/532 |
| 2131051 | 7/1981 | Germany | 102/450 |

*Primary Examiner*—Harold J. Tudor
*Attorney, Agent, or Firm*—Gregory S. Rosenblatt

[57] ABSTRACT

A water resistant shotshell has an internal moisture seal to preclude moisture intrusion into the propellant charge. The seal is at least one flexible tapered lip on the plastic shot wad which is compressed against the inside surface of the shotshell tube over the powder charge. The preferred embodiment is a two piece shot wad having a shot cup portion and a wad portion. The wad portion has a central disk portion and a tubular rim terminating in a pair of opposing flexible lips which provide a dual moisture seal.

19 Claims, 3 Drawing Sheets

WATER RESISTANT SHOT WAD

This application is a continuation of application Ser. No. 07/967,319, filed Oct. 28, 1992, now abandoned, which is incorporated herein by reference in its entirety.

BACKGROUND OF THE INVENTION

1. Field of the Invention

This invention generally relates to shotshells and more particularly to a water resistant shot wad/shot cup, and preferably to such a wad/cup for steel shot loads.

2. Description of the Related Art

Shotshells for water fowl hunting have increasingly utilized steel shot loads to avoid the alleged toxicity problems claimed to be associated with lead shot. Waterfowl hunting is normally done near the water. Duck hunting is normally done from a duck blind or a boat and often in wet conditions. Accordingly, it is not unusual for shotshells to get wet during waterfowl hunting. One of the banes of waterfowl hunters is wet shotshells which fail to function properly due to wet powder. One manner in which wet powder can occur is by water penetrating the shotshell fold crimp, passing between the shot cup and the shell, then between the over-powder-cup and the shell and eventually reaching the powder charge.

Conventional shotshells, such as are described in U.S. Pat. Nos. 3,289,586; 3,469,527; 3,623,431; 3,670,650; 3,788,224; 4,220,090; 4,233,903; 4,669,385; 4,676,170; and 4,679,505 have over powder wad columns which are not waterproof or water resistant. The over powder wad is designed to provide adequate pressure sealing against forwardly directed pressure acting against the rear of the wad due to the ignition gases but is not effective to seal against low pressure rearwardly flowing water or high humidity gas entering from the front of the wad column.

One solution, for moisture exclusion in roll crimped shotshells, is to provide a sealing top wad over the shot cup as described in U.S. Pat. No. 5,138,950, assigned to the assignee of the present invention. Another is to provide a thermoplastic seal over the top of the star or roll crimp as described in U.S. Pat. No. 4,991,512, also assigned to the assignee of the present invention.

From a manufacturing point of view, it would be more desirable to provide a moisture seal which is integral with a component that normally will be installed in the shotshell such as an over powder wad or shot cup to eliminate the necessity for providing an additional component to the shotshell. In addition, from a shooter's standpoint, it is preferable to seal from behind the shot so as to avoid having any extra components in front of the shot which might interfere with the shot patterning or clog gas ports of semi-automatic shotguns. However, there is no existing shotshell which has this ability to any degree of reliability, and reliability is of overriding concern to hunters who do not want to miss their target on account of ammunition failures.

Accordingly, it is an object of the present invention to provide a reliable moisture seal behind the shot load, preferably a seal which is integral with the shot wad so as to eliminate the necessity for extra components.

SUMMARY OF THE INVENTION

The shotshell in accordance with the present invention includes a plastic shot wad having a cup shaped over powder portion terminating in an annular, outwardly extending flexible lip having an outer diameter greater than the inside diameter of the shotshell case into which it is installed over the powder charge. This is applicable whether that tube is an injection molded tube, a compression-formed tube or reifenhauser-formed tube. This flexible, resilient lip, compressed by the inside surface of the shotshell wall, provides a reliable moisture seal against water leakage past the shot column into the powder chamber.

The shot column in accordance with the present invention may also include a shot cup which is either separate from, interengaged with, or even integral with the shot wad of the invention. The moisture sealing capabilities are further enhanced in the preferred embodiment by incorporating a second annular outwardly extending flexible lip above the lower lip. The sealing is even further enhanced by making this second lip project outwardly and upwardly to a greater diameter than that of the shot cup wall. Still further enhancement is preferably provided by causing the shot cup and over-powder wad to be separate yet interengaged by mating camming surfaces which tend to force the second lip outwardly into increased engagement with the inner wall of the shell case. In this last case a two piece shot cup and wad is utilized.

DETAILED DESCRIPTION OF THE PREFERRED EMBODIMENTS

Figure 2:
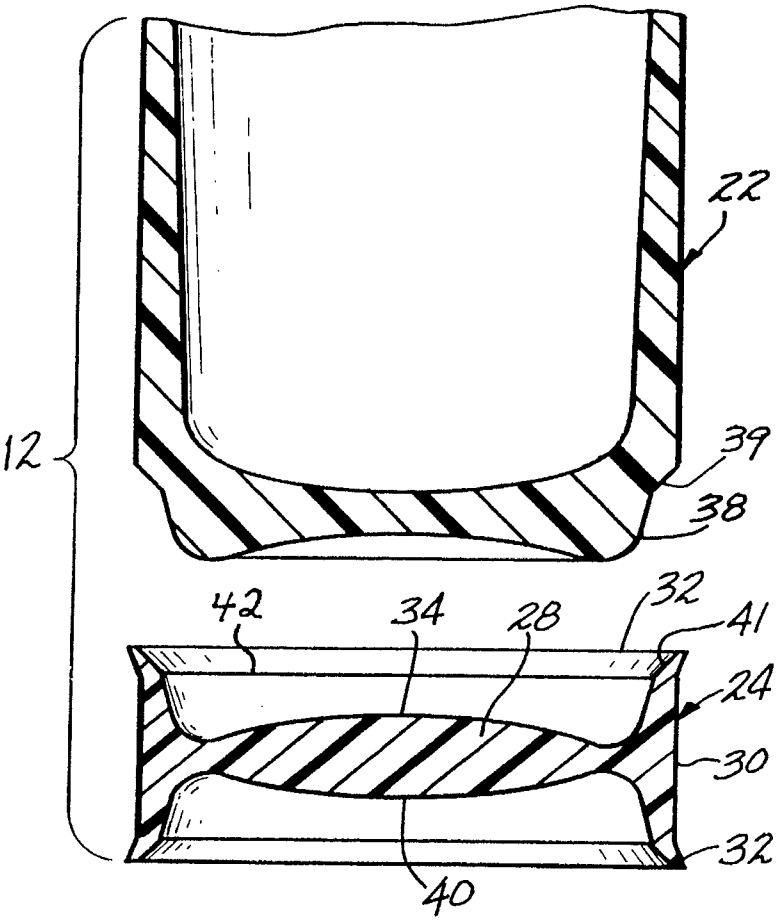
FIG. 2 is a longitudinal sectional exploded view of the wad portion and shot cup portion shown in FIG. 1.
Figure 1:
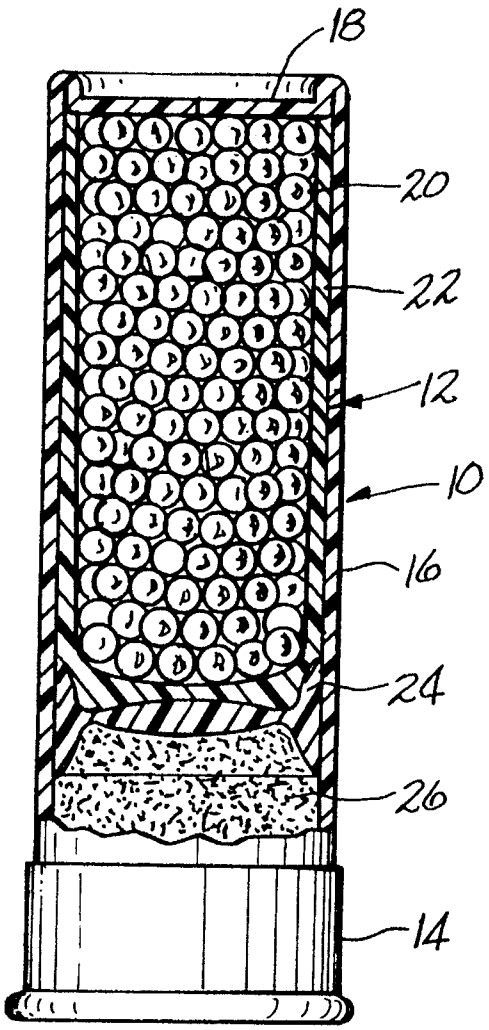
FIG. 1 is a side elevational view of a shotshell in accordance with the present invention with portions broken away to illustrate the shot wad in accordance with a first preferred embodiment of the present invention.

A shotshell 10 using a shot wad in accordance with the first embodiment of the present invention is shown in FIG. 1. FIG. 2 shows the wad and cup portions of the shot wad separate from the shotshell 10. Referring now to FIG. 1, shotshell 10 has a metal head 14 enclosing a basewad and primer (not shown) closing one end of the reifenhauser tubing 16. The other end of the tube 16 is closed by a conventional star crimp 18. Crimp 18 of shotshell 10 encloses a load of shot 20 inside the cup portion 22 of the shot wad 12. Beneath the shot cup portion 22 is a wad portion 24 followed by a propellant charge 26.

Referring now to FIG. 2, the shot wad 12 in accordance with the first embodiment of the present invention comprises a generally tubular cup shaped shot cup portion 22 and an over powder wad portion 24. Wad portion 24 has a central domed disk portion 28 which terminates in a tubular rim 30. Rim 30 has a diameter of about 15 thousandths i.e. 0.015 inches less than the inside diameter of the reifenhauser tubing 16, which, for a 12 gauge shotshell, is approximately 0.744 inches. The tubular rim 30 terminates in annular upper and lower lips 32 which extend and taper outwardly from rim 30 to a diameter of from about 0.010 to 0.015 inches greater than reifenhauser tubing internal diameter. Accordingly, lips 32 have an outer diameter of about 0.755 inches.

The tapered lips 32 are compressed into engagement with the inside surface of the tube 16 when the wad portion 24 is inserted into the shotshell 10. Insertion of the wad portion 24 into the tube 16 is assisted by use of an axially internally ridged bushing through which the wad portion is pressed to temporarily resiliently, partially compress the lips 32 of wad portion 24 to form grooves with a diameter between 0.030 and 0.035 inches less than the wad's free diameter prior to insertion of the wad into the reifenhauser tube 16. Temporary compression of lips 32 allows air to pass the wad during assembly to prevent air being trapped under the wad portion. The wad portion is then inserted into the reifenhauser tube 16, allowing trapped air in the tube 16 to be released as the wad portion is inserted. The wad portion 24 then relaxes to its original diameter of about 0.729 inches, with the lips 32 compressed and resiliently biased against the inside surface of the reifenhauser tube 16. The lips 32 provide a dual moisture seal against moisture intrusion because both the upper and lower lips 32 are resiliently compressed against the inside surface of the reifenhauser tube.

The upper surface 34 of the central disk portion 28 of the wad portion 24 is flat or has a dome shape to nest within a flat or concave bottom 36 of the shot cup portion 22 inside the reifenhauser tube 16. In addition, the bottom 36 has a tapered outer margin 38 which acts as a rearwardly tapered outer camming surface 39 which matches and accommodates a corresponding inner forwardly flared camming surface 41 on the upper portion of the rim 30 of the wad 24 when the shot cup and wad portions are nested together. The tapered lips 32 include an increasing inflection circumferential line 42 adjacent to the inner forwardly flared camming surface 41. These matching camming surfaces 39 and 40 also assist in proper alignment of wad portion 24 and shot cup portion 22 during assembly of the shotshell 10 Similarly, the bottom surface 40 of the central disk portion 28 has a corresponding flat or downwardly convex surface and a tapered outer margin and thus an overall cup shape over the powder chamber. This cup shaped surface, against which the gases generated by the propellant charge 26 press and expand upon charge ignition, produces an adequate gas seal between the wad and the reifenhauser tubing 16 and between the wad and the gun barrel during acceleration of the shot charge through the barrel and out the muzzle of the shotgun.

The wad portion 24 is symmetrical about its actual axis. It is preferably also symmetrical in cross section about its central transverse axis so that assembly does not involve a determination of orientation. That is, the top side and bottom side of the wad portion are preferably identical so that the wad portion 24 is just as effective if inserted upside down.

Figure 3:
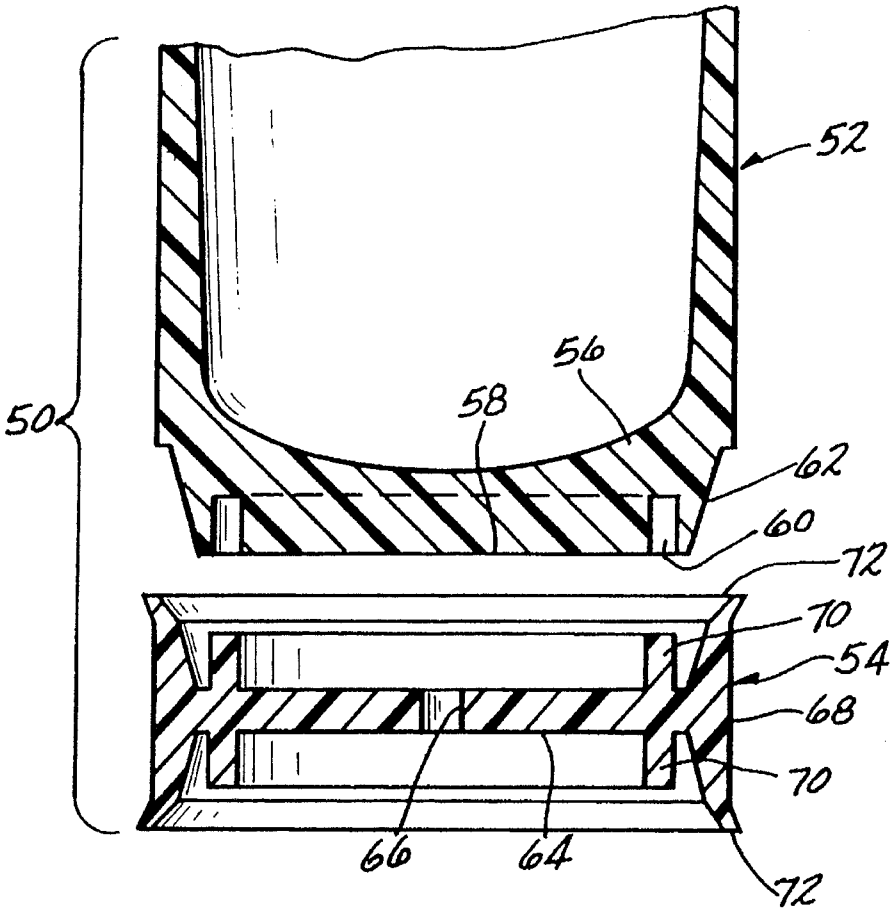
FIG. 3 is a longitudinal sectional exploded view of a second embodiment of a two piece shot wad and cup in accordance with the present invention.

A second embodiment of the shot wad assembly of the present invention is shown in FIG. 3. In the second embodiment, a two piece shot wad assembly 50 comprises a tubular closed bottom shot cup portion 52 and a wad portion 54. The bottom 56 of the shot cup portion 52 has a central, flat, disk portion 58 surrounded by an annular channel 60. Bottom 58 also has a tapered outer margin 62.

The wad portion 54 is an axially and transversely symmetrical circular, generally disk shaped body having a central flat disk portion 64 with a central axial bore 66. The disk portion 64 has a tubular rim 68 and a pair of tubular flanges 70 extending in opposite axial directions from the central disk portion 64 and spaced inwardly from the tubular rim 68. The tubular rim 68 of the wad portion 54 has flexible resilient tapered lips 72 extending outward from the upper and lower ends of the tubular rim 68. The lips 72 operate identically as described in the first embodiment.

When the shot wad 50 is assembled together, the tubular flange 70 fits within the channel 60 in the bottom 56 of the shot cup 52. Outer margin 62 fits in between flange 70 and rim 68. This arrangement provides a tortuous leakage path and thus a good seal against combustion gas leakage through bore 66. This tortuous path extends from bore 66 past tubular flange 70 tapered margin 62, and lip 72 to the outside of the shot cup portion 52 thus precluding gas leakage during propellant ignition.

The symmetrical design of the wad portion 54 enables orientation independent insertion of the wad into the shotshell case after having been precompressed as described in the first embodiment. In this second embodiment, it is not necessary to precompress the wad portion 54 by passing it through a bushing. The central bore 66 permits the escape of trapped air as the wad portion 54 is inserted in the tube 16 over the powder charge 26. The cup portion 52 is then inserted along with the shot load and seated against the wad portion 54. Finally, the open end 18 of the shotshell is conventionally crimped.

Figure 4:
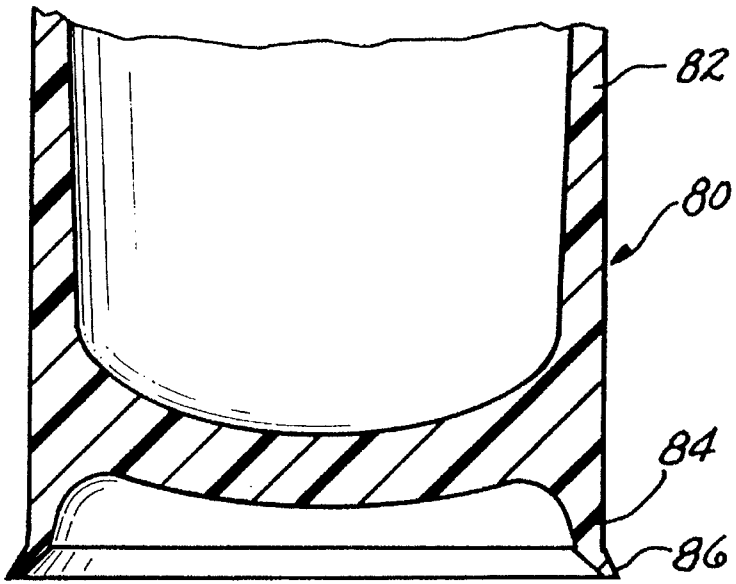
FIG. 4 is a longitudinal sectional view through a third embodiment of the shot wad in accordance with the present invention.

A third embodiment of the shot wad in accordance with the present invention is shown in FIG. 4. In this embodiment, shot wad 80 is a unitary body having an upper tubular cup portion 82 and an integral over powder cup portion 84 which terminates in an outwardly extending annular flexible, tapered lip 86 which functions identically to the lips 32 and 72 in the first two embodiments described above. However, in this embodiment the upper lip is dispensed with. The moisture seal is effected by the resilient lip 86 pressing outwardly against the inside surface of the reifenhauser tube 16. As in the first two embodiments, lip 86 has an outer diameter about 10 to 15 thousandths greater than the inside diameter of the reifenhauser tube 16.

Compression of the wads in the first embodiment by passing the wad through a bushing, causes the high or low density polyethylene wad to remain compressed when it is released from the bushing for a period of time called its "relaxation time". This relaxation time is on the order of several minutes, during which time the wad slowly returns to its original uncompressed diameter. During this period immediately following compression in the bushing, the wad is inserted into the shotshell over the charge of propellant powder and seated at an appropriate distance from the base wad to enclose the propellant charge 26.

Following insertion of the wad 24, 54, or 80, the shot cup 22 or 52 is inserted along with the required load of steel shot. Finally, the end 18 of the shotshell is closed in a star crimp or roll crimp in a conventional manner.

Referring back to FIGS. 1 and 2, the first embodiment of the shot wad in accordance with the present invention has been extensively immersion tested as indicated by Tables 1, 2 and 3 set forth below. Table 1 represents pressure, velocity and pattern data for test lots of 10 shotshells each of 12 gauge, 3 inch shotshells with 1¼ ounce of BB steel shot. The first entry in Table 1 is the control, utilizing a conventional one piece yellow steel shot wad. The second and third entries, which have the two piece shot wad 12 in accordance with the present invention, exhibit a velocity and pressure similar to the control. In addition, the two piece shot wad lots demonstrate a comparable if not an improved shot pattern.

Table 2 sets forth the results of a submergence test on identical Winchester® 3", 1¼ oz., steel shotshells which include two piece shot wads in accordance with the first embodiment of the invention. The cup portions were high density polyethylene (HDPE) and the wad portions were either HDPE or low density polyethylene (LDPE). In these tests, the shotshells were soaked in water for a period of 24 hours and then allowed to stand in air at 70° F. for periods of 1,3 and 7 days. As can be seen, water entered the shot cup, as evidenced by the weight gain, but did not enter the powder chamber. Velocity and pressure performance was similar to that shown in Table 1. There were no squibs, misfires, or other firing defects.

In contrast, Table 3 gives the water test results for standard Remington® and Federal® production shotshell. In all test cases, the primer pockets were sealed with lacquer. Note that with submergence in water for only 16 hours, there were a total of 10 misfires, an entirely unacceptable performance due to moisture entering the propellant chamber.

TABLE 1

PRESSURE AND VELOCITY AND 30" CIRCLE PATTERN DATA - 2 PIECE SHOT WADS SYMBOL XSV123BB (12 GA. 3" 1¼ OZ. BB STEEL)

| WAD TYPE | 1 Piece Yellow 1¼ oz (Control) | | | 2 Piece SS. w/LDPE P.C. | | | 2 Piece S.S. w/HDPE P.C. | | |
|---|---|---|---|---|---|---|---|---|---|
| PROPELLANT | HERC 378-006 @ 33.0 gr. | | | HERC 378-006 @ 33.0 gr. | | | HERC 378-006 @ 34.0 gr. | | |
| SHOT WEIGHT | 548 gr. (91 Pellets) | | | 549 gr. (91 Pellets) | | | 549 gr. (91 Pellets) | | |
| TEMP (°F.) | 70 | +125 | 0 | 70 | +125 | 0 | 70 | +125 | 0 |
| N | 10 | 10 | 10 | 10 | 10 | 10 | 20 | 20 | 20 |
| VELOCITY (FT/S) | | | | | | | | | |
| AVG. | 1346 | 1382 | 1392 | 1319 | 1351 | 1305 | 1336 | 1351 | 1322 |
| EV. | 68 | 48 | 44 | 66 | 31 | 53 | 44 | 67 | 72 |
| SD. | 19 | 13 | 73 | 20 | 10 | 17 | 11 | 72 | 23 |
| PRESSURE PSI × 102 | | | | | | | | | |
| AVG. | 109 | 103 | 124 | 109 | 104 | 117 | 109 | 109 | 118 |
| MAX. | 117 | 109 | 129 | 118 | 108 | 124 | 118 | 109 | 128 |
| MIN. | 102 | 97 | 117 | 101 | 99 | 110 | 100 | 93 | 108 |
| SD. | 4.7 | 3.3 | 4.0 | 5.4 | 2.9 | 5.5 | 4.5 | 4.6 | 7.0 |
| PELLET COUNT | | | | | | | | | |
| AVG. | 76.4 | | | 79.7 | | | 81.1 | | |
| EV. | 12 | | | 11 | | | 10 | | |
| SD. | 4.4 | | | 4.2 | | | 3.6 | | |
| PATTERN % | | | | | | | | | |
| AVG. | 83.2 | | | 86.9 | | | 88.3 | | |
| MAX. | 87 | | | 91 | | | 94 | | |
| MIN. | 74 | | | 79 | | | 83 | | |
| SD. | 4.6 | | | 4.6 | | | 4.6 | | |

TABLE 2

WATER TEST RESULTS - 2 PIECE STEEL SHOT WADS (N = 20)

| WAD SAMPLE | 2 Piece Stool Shot LOPE P.C. | | | 2 Piece SS. w/HDPE P.C. | | |
|---|---|---|---|---|---|---|
| PROPELLANT | HERC 378-006 @ 33.0 gr. | | | HERC 378-006 @ 34.0 gr. | | |
| CRIMP | Reif. w/ S.S. | | | Reif. w/ S.S. | | |
| STORAGE TIME | | | | | | |
| HRS. IN $H_2O$ | 24 | 24 | 24 | 24 | 24 | 24 |
| DAYS IN AIR @ 70° C. | 1 | 3 | 7 | 1 | 3 | 7 |
| WATER WT. GAIN (GRAINS) | | | | | | |
| AVG. | 3.9 | 2.9 | 4.9 | 3.0 | 7.3 | 4.6 |
| MAX. | 21.2 | 5.7 | 30.2 | 8.2 | 3.9 | 20.9 |
| MIN. | 0 | 0.8 | 0.8 | 0.9 | 0.9 | 0.7 |
| FIRING DEFECTS | | | | | | |
| SQUIB. | 0 | 0 | 0 | 0 | 0 | 0 |
| MISFIRE. | 0 | 0 | 0 | 0 | 0 | 0 |
| OFFSOUND | 0 | 0 | 0 | 0 | 0 | 0 |
| VELOCITY (FT/S) | | | | | | |
| AVG. | 1310 | 1301 | 1309 | 1330 | 1341 | 1335 |
| MAX. | 1337 | 1324 | 1354 | 1356 | 1380 | 1362 |
| MIN. | 1270 | 1275 | 1263 | 1309 | 1319 | 1297 |
| SD. | 18 | 15 | 24 | 14 | 15 | 17 |
| PRESSURE PSI × 100 | | | | | | |
| AVG. | 105 | 105 | 105 | 107 | 111 | 111 |
| MAX. | 111 | 114 | 118 | 113 | 123 | 120 |
| MIN. | 955 | 96 | 97 | 99 | 104 | 102 |
| SD. | 4.2 | 4.7 | 6.4 | 4.0 | 4.7 | 4.6 |

TABLE 3

WATER TEST RESULTS WITH PRESSURE & VELOCITY DATA
12 GA. 2¾" 1¼ OZ. STEEL SHOT LOADS N = 20

| SAMPLE | Control Federal/W148 One Piece Wad Steel Shot | | | | | Remington for STL 125 Meg. One Piece Wad Sheet Shot | | | | |
|---|---|---|---|---|---|---|---|---|---|---|
| PROPELLANT | HERC 205 | | | | | HERC 370 | | | | |
| WAD COLUMN | (std. prod. 1¼" steel shot wad) | | | | | (std. prod. 1¼" steel shot wad) | | | | |
| CRIMP | 6 seg. C.F. | | | | | 6 seg. C.F. | | | | |
| STORAGE TIME | | | | | | | | | | |
| HOURS IN $H_2O$ | 0 | 21 | 21 | 21 | 21 | 0 | 21 | 21 | 21 | 21 |
| DAYS IN AIR @ 70° | 21/24 | 0 | 1 | 2 | 7 | 21/24 | 0 | 1 | 2 | 7 |
| WATER WT. GAIN | | | | | | | | | | |
| AVG. | 0 | 15.7 | 18.0 | 16.1 | 22.2 | 0 | 3.6 | 4.6 | 4.1 | 7.1 |
| MAX. | 0 | 25.5 | 32.1 | 33.2 | 31.6 | 0 | 7.2 | 7.6 | 7.9 | 21.8 |
| MIN. | 0 | 10.0 | 6.1 | 7.4 | 9.5 | 0 | 1.8 | 1.7 | 1.9 | 1.7 |
| FIRING DEFECTS | | | | | | | | | | |
| SQUIB. | 0 | 0 | 0 | 0 | 0 | 0 | 0 | 2 | 2 | 0 |
| MISFIRE. | 0 | 0 | 0 | 0 | 1 | 0 | 0 | 1 | 2 | 5 |
| OFFSOUND | 0 | 0 | 0 | 0 | 0 | 0 | 3 | 3 | 5 | 1 |
| VELOCITY (FT/S) | | | | | | | | | | |
| AVG. | 1277 | 1242 | 1218 | 1158 | 1123 | 1264 | 1112 | 767 | 589 | 981 |
| MAX. | 1292 | 1279 | 1248 | 1202 | 1181 | 1307 | 1216 | 1083 | 1054 | 1148 |
| MIN. | 1255 | 1188 | 1150 | 1107 | 1016 | 1225 | 987 | 425 | 332 | 704 |
| STD. DEV. | 11 | 26 | 31 | 29 | 46 | 28 | 68 | 255 | 266 | 165 |
| PRESSURE PSI × 100 | | | | | | | | | | |
| AVG. | 121 | 113 | 108 | 90 | 90 | 119 | 88 | 61 | 48 | 72 |
| MAX. | 126 | 125 | 122 | 103 | 113 | 132 | 106 | 86 | 89 | 89 |
| MIN. | 116 | 95 | 91 | 78 | 70 | 108 | 73 | 33 | 23 | 45 |
| STD. DEV. | 3.9 | 10.4 | 8.2 | 7.7 | 12.5 | 8.9 | 11.3 | 20.5 | 24.4 | 16.2 |

As can be seen by comparing Tables 2 and 3, the shot wads in accordance with the present invention preclude entry of moisture into the powder chamber of the shotshell. This improved seal is due to the presence of the outwardly extending lips 32 which compressively engage the inside wall surface of reifenhauser tubing 16. Although moisture does get into the shot column, as illustrated by the water weight gain set forth in Table 2, little effect is seen on performance, velocity, and pressure.

Figure 5:
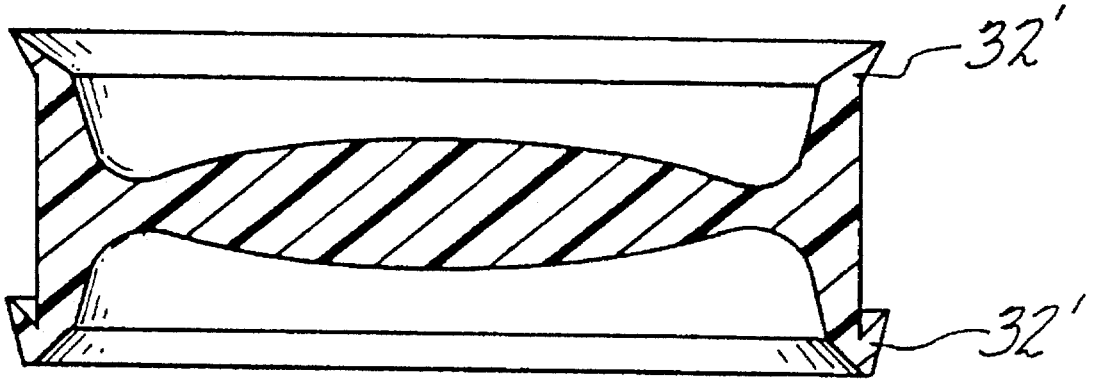
FIG. 5 is a longitudinal sectional exploded view of the wad portion and shot cup portion as shown in FIG. 1 in which two flared lips are flared in the same direction.

While the flared lips of the shotshell wad cup are preferably flared in opposing directions as illustrated in FIG. 2, it is within the scope of the invention for the flared lips 32' to flare in the same direction as illustrated in FIG. 5.

While the invention has been described above with reference to specific embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims. All patent applications, patents, and other publications cited herein are incorporated by reference in their entirety.

What is claimed is:

1. A shotshell wad cup, comprising:

a cup portion for holding a shot charge having a camming surface at a rear end; and a wad portion interengaged with said cup portion having a resilient outwardly flared lip extending outwardly therefrom with a flare increasing inflection circumferential line on an inside outwardly flared surface of the wad portion which increases the outward flare of said inside surface of the wad portion and a flored camming surface adjacent to said flared lip;

the camming surface of said cup portion interengaged with the camming surface of the wad portion whereby when said shotshell wad cup is inserted into a shotshell, said flared lip is forced into increased engagement with an inside surface of the shotshell to provided a seal against moisture intrusion into a propellant charge contained within the shotshell.

2. The shotshell wad cup according to claim 1 wherein the flared lip is a tubular extension of the wad portion.

3. The shotshell wad cup according to claim 2 wherein the tubular extension is tapered to increase flexibility.

4. The shotshell wad cup according to claim 2 wherein the flared lip flares outwardly to a diameter greater than a maximum diameter of a central portion of the wad portion.

5. The shotshell wad cup according to claim 4 wherein the wad portion contains at least two flared lips.

6. The shotshell wad cup according to claim 5 wherein the two flared lips are flared in opposite directions.

7. The shotshell wad cup according to claim 2 wherein the cup portion has an outer rearwardly tapered camming surface and the wad portion has a matching inner upwardly flared camming surface.

8. The shotshell wad cup according to claim 7 wherein the wad portion has identical forward and rearward surfaces to prevent any adverse effect from inversion of the wad portion during assembly of the shotshell.

9. The shotshell wad cup according to claim 2 wherein the wad portion has a central disk portion and a tubular rim, the tubular rim terminating in a pair of oppositely directed tapered lips.

10. A shotshell, comprising:

a tubular plastic case body having a head closing one end;

a propellant charge;

a shot load; and a shot wad having separate cup and wad portions;

said cup portion containing the shot load and having a camming surface at a rear end;

and said wad portion overlying the propellant charge and having a resilient outwardly flared lip extending outwardly therefrom with a flare increasing inflection circumferential line on an inside outwardly flared surface of the wad portion which increases the outward flare of said inside surface of the wad portion, said wad portion further containing a flared camming surface adjacent to said flared lip, the camming surface of said cup portion interengaged with the camming surface of the wad portion to force said flared lip into increased engagement with the inside surface of the case body to provide a seal against moisture intrusion into the propellant charge.

11. The shotshell according to claim 10 wherein the flared lip is a tubular extension of the wad portion.

12. The shotshell according to claim 11 wherein the tubular extension is tapered to increase flexibility.

13. The shotshell according to claim 11 wherein the flared lip extends outward to a diameter greater than the maximum diameter of a central portion of the wad portion.

14. The shotshell according to claim 13 wherein the wad portion contains at least two flared lips.

15. The shotshell according to claim 14 wherein the two flared lips are flared in opposite directions.

16. The shotshell according to claim 11 wherein the cup portion has an outer rearwardly tapered camming surface and the wad portion has a matching inner upwardly flared camming surface.

17. The shotshell according to claim 11 wherein the wad portion has identical forward and rearward surfaces to prevent any adverse effect from inversion of the wad portion during assembly of the shotshell.

18. The shotshell according to claim 11 wherein the wad portion has a pair of tapered lips compressed against the case body to form the seal.

19. The shotshell according to claim 11 wherein the wad portion has a central disk portion and a tubular rim, the tubular rim terminating in a pair of oppositely directed tapered lips.

* * * * *